United States Patent [19]

Cannon

[11] 4,441,336

[45] Apr. 10, 1984

[54] COOLER HAVING FREEZE BOTTLE INSERT

[75] Inventor: John P. Cannon, Overland Park, Kans.

[73] Assignee: Plattner Industries, Inc., Ottawa, Kans.

[21] Appl. No.: 410,579

[22] Filed: Aug. 23, 1982

[51] Int. Cl.[3] ..... F25D 3/08

[52] U.S. Cl. ..... 62/457; 62/371; 62/529

[58] Field of Search ..... 62/371, 372, 430, 457, 62/529, 530

[56] References Cited

U.S. PATENT DOCUMENTS

| | | | |
|---|---|---|---|
| 2,496,296 | 2/1950 | Lobl | 62/457 X |
| 3,255,607 | 6/1966 | Bair et al. | 62/457 X |
| 3,802,220 | 4/1974 | Pompo | 62/457 |
| 3,974,658 | 8/1976 | Starrett | 62/457 X |
| 4,266,407 | 5/1981 | Gibson | 62/371 |

*Primary Examiner*—Lloyd L. King

*Attorney, Agent, or Firm*—Schmidt, Johnson, Hovey & Williams

[57] ABSTRACT

A portable cooler has a hollow chest provided with a lid and with a lower food compartment as well as an upper food chamber used alternately depending upon the horizontal or vertical disposition of a capped bottle in the chest. Water in the bottle is initially frozen and beverage cans are then placed against concavities formed exteriorly of the bottle. Tabs on the ends of the bottle are either caused to slide within opposed grooves in the chest or laid on an upwardly-facing shoulder in the chest.

4 Claims, 10 Drawing Figures

Fig. 1
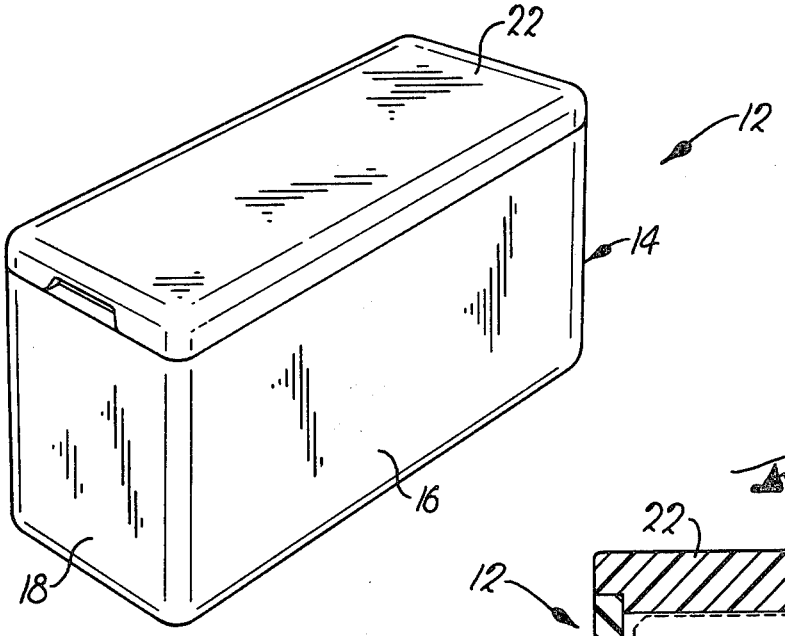
Fig. 3
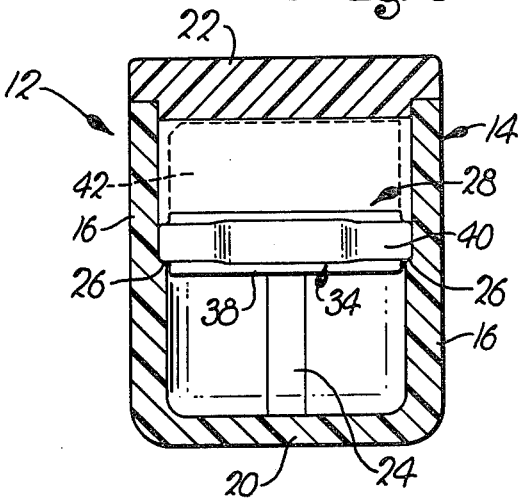
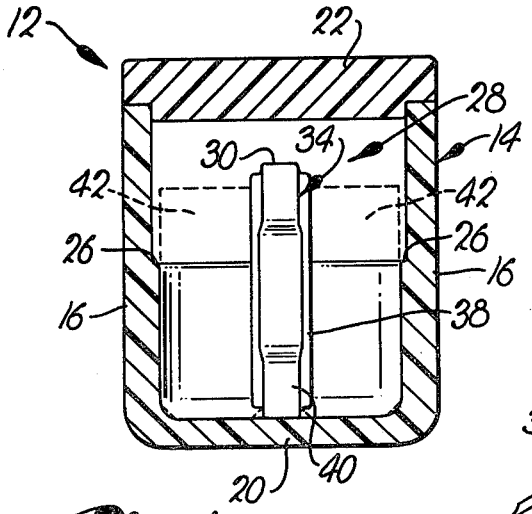
Fig. 4
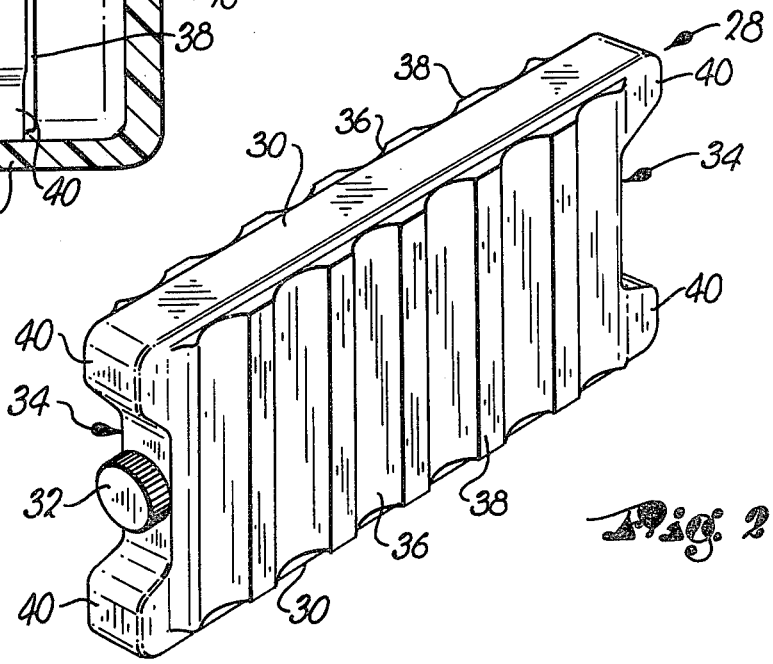
Fig. 2

Fig. 5
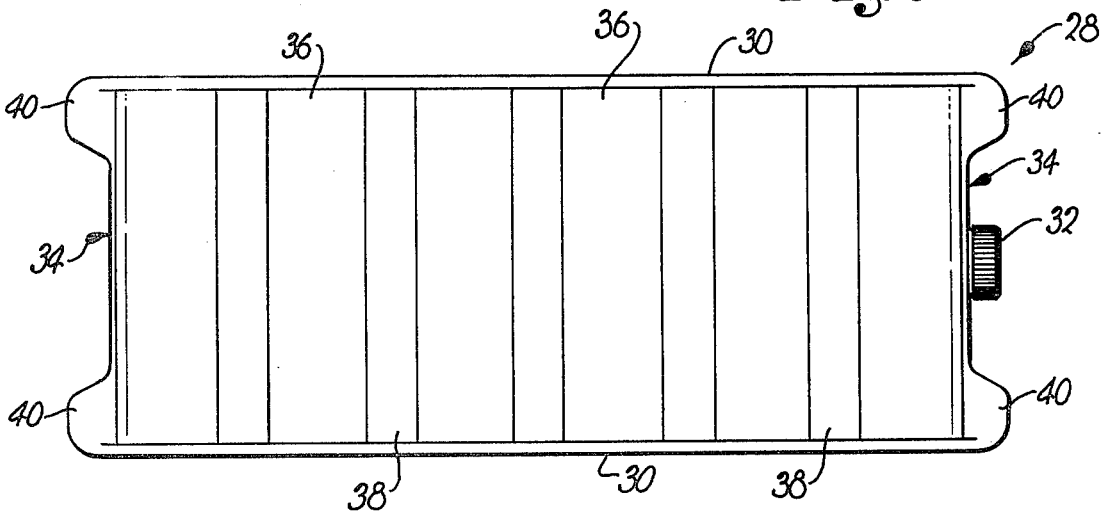
Fig. 6
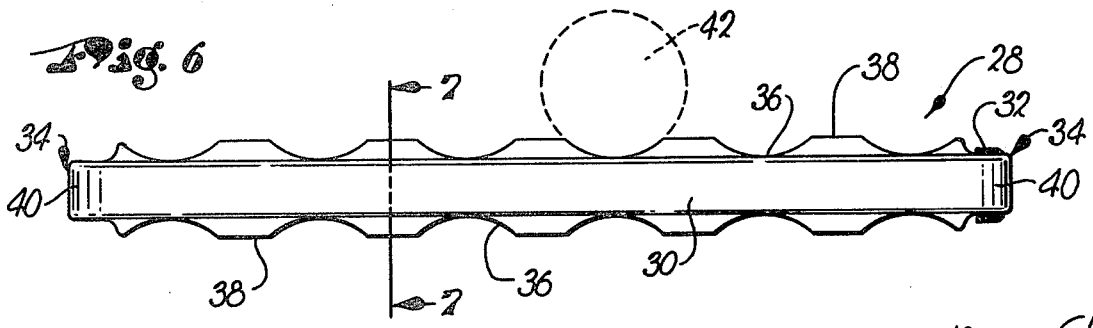
Fig. 7
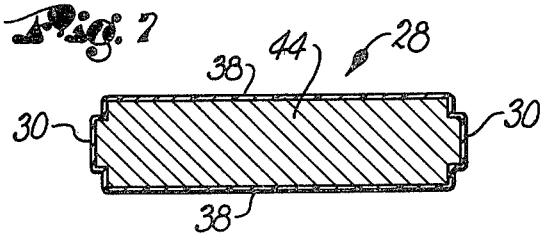
Fig. 8
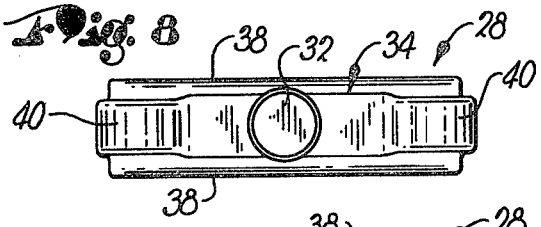
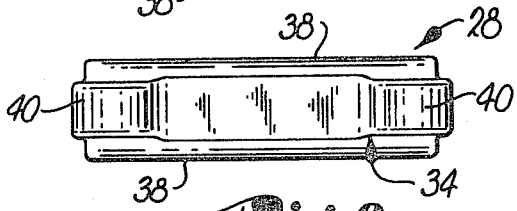
Fig. 9
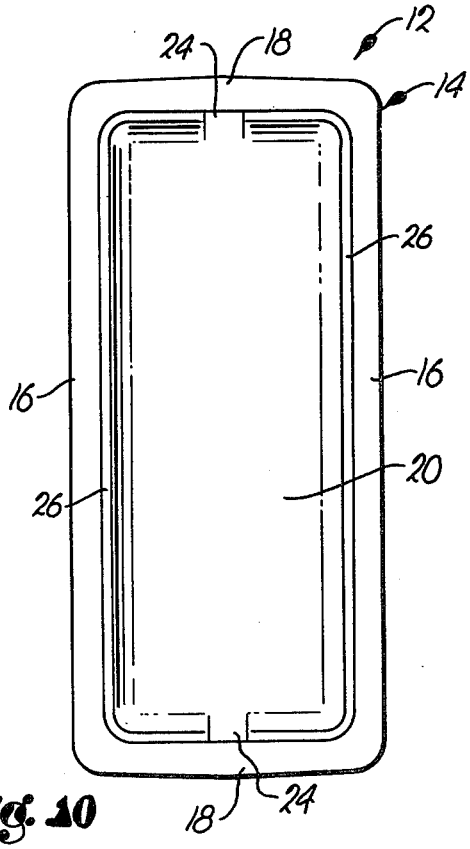
Fig. 10

COOLER HAVING FREEZE BOTTLE INSERT

Portable coolers for preserving foods and beverages carried by travelers or for use at picnics, parties, public events and otherwise are universally deficient with respect to a suitable cooling medium placed in or on the cooler for such preservation purposes. Crushed or cubed ice in the cooler must be bagged to protect the edibles and prevent pooling of the melted ice in the bottom of the cooler. Dry ice must be handled with extreme care. And, in neither instance is it possible to provide sufficient direct contact between the ice and the food or beverage containers to reduce the temperature as low as oftentimes might be required or desired, especially in the case of beverages. Beverage containers are commonly packed in ice, but at the point of use there is presented the undesirable task of digging the containers out of the partially melted ice, and the surfaces of the containers are usually unpleasantly wet and slippery. Moreover, in such practice it is somewhat impractical to pack sandwiches and other foods in the same cooler.

Also well known, of course, are ice bags applied to the body to relieve pain; large ice-boxes in which ice is used to cool foods; mechanical refrigeration; and ice trays used in freezer compartments.

As distinguished from all such prior art of which I am presently aware, the problems above enumerated are solved by the cooler of my present invention which includes a watertight bottle removably inserted within a portable chest with the water content of the bottle prefrozen. The bottle is so shaped as to permit direct contact therewith by a number of containers, such as beverage cans, so that the beverages can be kept at a much lower temperature than the other food products placed in the chest, all the while eliminating the rather messy conditions that result from packing foods and beverages in melting ice for temporary preservation purposes.

In the drawings

FIG. 1 is a perspective view of a chest adapted to receive a freeze bottle insert in accordance with my present invention;

FIG. 2 is a perspective view showing one side of the bottle;

FIG. 3 is a transverse cross-sectional view showing one position of the bottle in the chest;

FIG. 4 is a view similar to FIG. 3 showing another position of the bottle in the chest;

FIG. 5 is an elevational view showing the opposite side of the bottle;

FIG. 6 is a view showing one edge of the bottle;

FIG. 7 is a cross-sectional view taken on line 7—7 of FIG. 6;

FIG. 8 is a view showing one end of the bottle;

FIG. 9 is a view showing the opposite end of the bottle; and

FIG. 10 is a top plan view of the chest with its top removed.

A portable cooler 12 for foods and beverages includes a hollow chest 14 which may be either insulated throughout or, as shown, be made of any suitable, readily available, strong, light-weight material having relatively low heat transfer properties. The chest 14 has a pair of side walls 16, 16; a pair of end walls 18, 18; a bottom wall 20, all integrally interconnected; and a removable lid 22, the latter of which may be provided with releasable latch means or the like (not shown). Not illustrated also is a carrying bail for the chest 14 if such should be desired. Each wall 18, 18 has an internal groove 24 intermediate the walls 16, 16 extending upwardly from wall 20 to an internal, upwardly-facing shoulder 26 along the walls 16, 16 and 18, 18.

An elongated, waterproof bottle 28 adapted for placement in the chest 14 in two preselected positions (FIGS. 3 and 4), has a length approximately the same as the distance between the walls 18, 18 and a width that is only slightly less than the distance between the walls 16, 16 above the shoulder 26, the longitudinal edges 30, 30 of the bottle 28 being relatively narrow. Any suitable, readily available, tough, lightweight, flexible and resilient material may be employed for the bottle 28 except only that it cannot be unduly elastic such as to balloon when filled with water upon removal of a cap 32 at one of the ends 34 of the bottle 28.

The opposed, outer, side surfaces of the bottle 28 are corrugated such as to present a series of identical, elongated, spaced apart, longitudinally straight, transversely arcuate concavities 36, open at their ends and extending from one edge 30 to the opposite edge 30. Alternating with the concavities 36 on each side surface of the bottle 28 is a series of identical, elongated, spaced apart, flat ridges 38 extending from one edge 30 to the opposite edge 30. The concavities 36 and the ridges 38 span the distance between the ends 34.

Each end 34 has a pair of spaced tabs 40 of approximately the same widths at the widths of the edges 30 and slightly narrower than the widths of the grooves 24. The concavities 36 conform in shape with cylindrical beverage containers (cans) 42 to be carried by the chest 24.

OPERATION

Prior to packing the chest 14 with foods and beverages the bottle 28 (by virtue of the cap 32) is filled with water and then placed in any available freezer compartment to form an ice block 44 in the bottle 28. The bottle 28 may then be placed vertically in the chest 14 by sliding the tabs 40 downwardly along the grooves 24 until one edge 30 of the bottle 28 rests on the bottom 20 (FIG. 4). Two rows of upright containers 42 may then be placed on the bottom 20 in engagement with the concavities (see also FIG. 6). Thereafter, there is presented a chamber 46 in the chest 14 above the containers 42 available for receiving sandwiches, dishes of food and the like to also be kept cool by the ice pack 44 after closing of lid 22.

Alternately, (FIG. 3) a compartment 48 in the chest 14 may be filled with food items before horizontal disposition of the bottle 28 in the chest 14 with the tabs 40 resting on the shoulder 26. Then the containers are laid in place in the upwardly facing concavities 36 of the bottle 28.

It can now be appreciated that, by virtue of the intimate contact of the containers 42 (usually metal) with the bottle 28, the heat will be absorbed from the beverages and the temperature lowered sufficiently to satisfy those who desire cold drinks. On the other hand, food in the chamber 46 or the compartment 48 will also be cooled to such extent as to provide the safety needed to preclude undue bacterial growth, at least until the ice pack 44 is fully melted. All the while, the melted content of the bottle 28 is retained therein such as to preclude wetting of the contents of the cooler 12 exteriorly of the bottle 28.

I claim:

1. A portable cooler including:

a hollow chest having a top lid adapted to be opened for rendering the interior of the chest accessible;

a closed, ice-filled bottle for local application of cold to the contents of a plurality of individual containers to be placed in said chest; and means in the chest for retaining the bottle in a preselected position within the chest, said bottle having a corrugated, outer surface, presenting a series of spaced, elongated concavities, each cavity conforming in shape with the outer configuration of a corresponding container to be placed in the chest, whereby the containers directly engage the bottle in the concavities both longitudinally and transversely of the concavities, said bottle being waterproof whereby, as the ice melts in response to absorption of the heat of said container contents, the resultant liquid will be retained in the bottle, said chest having upwardly-facing shoulder means intermediate said lid and the bottom of the chest for supporting the bottle horizontally in the chest, said surface of the bottle facing upwardly when the bottle is resting on said shoulder means, said chest having a pair of opposed walls, each wall having an internal, upright, bottle-receiving groove for optional support of the bottle vertically in the chest.

2. The invention of claim 1, said bottle having a pair of opposed ends and a pair of spaced tabs on each end respectively, said tabs resting on said shoulder means when the bottle is disposed horizontally in the chest.

3. The invention of claim 2, said bottle having a second corrugated, outer surface presenting a series of spaced, elongated cavities whereby two rows of said containers may be placed in the chest in engagement with the bottle, said bottle being between said rows when received in said grooves.

4. The invention of claim 3, said tabs being slidable into and out of said grooves when the bottle is to be disposed vertically in the chest.

* * * * *